United States Patent [19]

Akutsu et al.

[11] Patent Number: 4,918,046

[45] Date of Patent: Apr. 17, 1990

[54] HEAT-SENSITIVE RECORDING MATERIAL

[75] Inventors: Mitsuo Akutsu, Tokyo; Syuji Iwakura, Saitama; Keiji Oya, Saitama; Keiji Tabata, Saitama, all of Japan

[73] Assignee: Adeka Argus Chemical Co., Ltd., Tokyo, Japan

[21] Appl. No.: 285,709

[22] Filed: Dec. 16, 1988

[30] Foreign Application Priority Data

| | | | |
|---|---|---|---|
| Jan. 7, 1988 | [JP] | Japan | 63-1617 |
| Feb. 23, 1988 | [JP] | Japan | 63-39882 |
| Mar. 18, 1988 | [JP] | Japan | 63-66412 |

[51] Int. Cl.[4] ..... B41M 5/18

[52] U.S. Cl. ..... 503/216; 427/150; 503/217; 503/225

[58] Field of Search ..... 427/150–152; 503/216, 217, 225

[56] References Cited

U.S. PATENT DOCUMENTS

| | | | |
|---|---|---|---|
| 4,536,779 | 8/1985 | Nachbur et al. | 503/216 |
| 4,542,395 | 9/1985 | Saito et al. | 503/216 |
| 4,612,557 | 9/1986 | Hama et al. | 503/216 |
| 4,630,080 | 12/1986 | Satake et al. | 503/216 |
| 4,729,984 | 3/1988 | Hama et al. | 503/216 |

*Primary Examiner*—Bruce H. Hess

*Attorney, Agent, or Firm*—Frishauf, Holtz, Goodman & Woodward

[57] ABSTRACT

A heat-sensitive recording material which comprises a usually colorless or light-colored coloring material together with one or more compounds selected from among bissulfonate compounds, 2-substituted cyclohexyl sulfonate derivatives and biscycloalkyl aryldisulfonate derivatives.

2 Claims, No Drawings

HEAT-SENSITIVE RECORDING MATERIAL

BACKGROUND OF THE INVENTION

1. Field of the Invention

This invention relates to a heat-sensitive recording material. More particularly, it relates to a heat-sensitive recording material which comprises a bissulfonate compound, a 2-substituted cyclohexyl sulfonate derivative or a biscycloalkyl aryldisulfonate derivative.

2. Description of the Prior Art

A heat-sensistive recording material is usually produced by applying a colorless or light-colored coloring material and a developer, which induces the coloration of said coloring material upon heating and is separated therefrom, together with other additives, for example, a sensitizer and a binder onto the surface of a substrate such as paper, synthetic paper, plastic film or plastic sheet. When the obtained recording material comes into contact with a heating element such as a thermal head or a heat pen, it shows, for example, a black coloration caused by the reaction between the coloring material and the developer.

Recording materials of the abovementioned type have various advantages such that they require no complicated treatments such as development or fixing, different from other ones; that they are available in recording with the use of a relatively simple device within a short period of time; that they are accompanied by little noise generation and environmental pollution; and that they are inexpensive. Therefore, these recording materials have been widely used not only in copying books and documents but also as a recording material for various instruments including measuring devices, computers, facsimiles, telexes, automatic ticket machines, prepaid cards and labels.

There have been proposed various acidic materials as a developer for thermally inducing the coloration of a coloring material. In particular, phenolic compounds such as bisphenol A, benzyl p-hydroxybenzoate, 4,4'-cyclohexylidenediphenol, 1,1,3-tris(3'-tert-butyl-4'-hydroxy-6'-methylphenylbutane and mixtures thereof have been employed for this purpose. However the use of these phenols in accompanied by some troubles, for example, an insufficient coloring sensitivity, color nonuniformity of reversion, or discoloration upon storage.

Therefore it has been attempted to establish a high coloring sensitivity by using a sensitizer, as the third component, together with a coloring material and a developer. Examples of conventional sensitizers include 4-benzyloxybiphenyl, dimethyl phthalate, stearamide and phenyl benzoate. However each of these sensitizers can not give a satisfactory effect.

It has been further proposed to use a sulfonate derivative as a sensitizer (cf. Japanese Patent Laid-Open No. 73990/1984). This sensitizer improves the coloring sensitivity to a certain extent, though it is yet insufficient. In addition, this method is accompanied by color nonuniformity and reversion and the stability upon storage thereof is unsatisfactory. Furthermore it has been proposed to use a sulfonate derivative as a developer (cf. Japanese Patent Laid-Open No. 109,388/1984). However this developer shows an insufficient printing speed and a low stability upon storage, when used alone. Thus it is required to use an amine compound therewith as a coloring aid. Although the use of the coloring aid is effective in the improvement of the coloring sensitivity, it would lower the stability upon storage. Thus this method is to be further improved.

SUMMARY OF THE INVENTION

Under these circumstances, the present inventors have studied to develop a developer which has an excellent coloring sensitivity, shows neither color nonuniformity nor color reversion and suffers from neither discoloration nor color reversion upon storage. As a result, they have found that the use of a specific bissulfonate, a specific 2-substituted cyclohexyl sulfonate or a specific biscycloalkyl aryldisulfonate makes it possible not only to significantly elevate the printing speed and coloring sensitivity without using any sensitizer or coloring aid but also to considerably improve the solvent resistance and stability upon storage.

The present inventors have further found that the combined use of the abovementioned specific biscycloalkyl aryldisulfonate with a conventional developer would exert an excellent sensitizing effect. Namely the biscycloalkyl aryldisulfonate is also available as a sensitizer.

The present invention has been completed based on these findings. Accordingly it provides a heat-sensitive recording material having a coloring layer containing a colorless or light-colored coloring material and a developer capable of inducing the coloration of said coloring material upon heating, which comprises one or more compounds selected from among those represented by the following general formulae (I), (II) and (III) as a developer.

The present invention further provides a heat-sensitive recording material which comprises a compound represented by the following general formula (III) as a sensitizer in addition to the abovementioned coloring material and a common developer.

General formula (I):

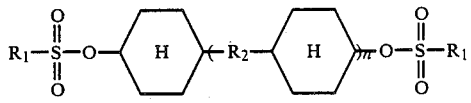

(I)

wherein $R_1$ represents an alkyl group, an aryl group, an aralkyl group or an alkylaryl group, each optionally substituted with a halogen atom, an alkoxy group, an acyl group, an alkoxycarbonyl group or a nitro group;

$R_2$ represents a direct bond, an alkylidene, —O—, —S— or —$SO_2$—; and n is 0 or 1.

General formula (II):

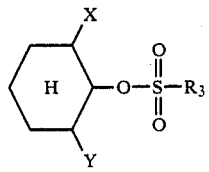

(II)

wherein $R_3$ represents an alkyl group, an aryl group, a cycloalkyl group, an arylalkyl group or an alkylaryl group; and X and Y each independently represent a hydrogen atom, an alkyl group, a cycloalkyl group or an arylalkyl group, provided that X and Y do not simultaneously represent hydrogen atoms.

General formula (III):

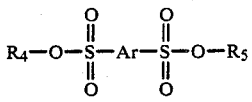

(III)

wherein $R_4$ and $R_5$ each independently represent a cycloalkyl group or a substituted cycloalkyl group; and Ar represents an aryl group.

The heat-sensitive recording material of the present invention has an excellent coloring sensitivity as well as a high stability upon storage and a high solvent resistance.

DETAILED DESCRIPTION OF THE INVENTION

Now the compound of the above general formula (I) to be used in the present invention will be described.

Examples of the $R_1$ group in the compound represented by the above general formula (I) include alkyl groups such as methyl, ethyl, propyl, isopropyl, butyl, isobutyl, secbutyl, tert-butyl, hexyl and trifluoromethyl groups; aryl or alkylaryl groups such as phenyl, 1-naphthyl, 2-naphthyl, tetrahydronaphthyl, methylphenyl, butylphenyl, dodecylphenyl, dimethylphenyl, methoxyphenyl, methoxynaphthyl, acetyloxynaphthyl, nitrophenyl, chlorophenyl and dimethoxycarbonylphenyl groups; and aralkyl groups such as benzyl and 2-phenylpropyl groups.

Examples of the alkylidene group represented by $R_2$ include methylidene, ethylidene, 2,2-propylidene, butylidene and cyclohexylidene groups.

Therefore examples of the bissulfonate compound of the general formula (I) to be used in the present invention are as follows.

TABLE 1

No. I-1: 1,4-cyclohexanediol bis(benzenesulfonate)
No. I-2: 1,4-cyclohexanediol bis(4-methylbenzenesulfonate)
No. I-3: 1,4-cyclohexanediol bis(4-methoxybenzenesulfonate)
No. I-4: 2,2-bis(4-hydroxycyclohexyl)propane bis(4-methylbenzenesulfonate)
No. I-5: 2,2-bis(4-hydroxycyclohexyl)propane bis(4-methoxybenzenesulfonate)
No. I-6: 2,2-bis(4-hydroxycyclohexyl)propane bis(methanesulfonate)
No. I-7: 2,2-bis(4-hydroxycyclohexyl)propane bis(benzenesulfonate)
No. I-8: thiobis(4-cyclohexanol) bis(benzenesulfonate)
No. I-9: sulfobis(4-cyclohexanol) bis(4-methylbenzenesulfonate)

The bissulfonate compound of the general formula (I) can be readily prepared by, for example, reacting the corresponding sulfonic acid chloride with a cyclohexanol compound in the presence of a hydrochloric acid binder such as pyridine.

Now examples of a process for synthesizing the bissulfonate compound of the general formula (I) to be used in the present invention will be given. In this regard it is to be understood that the present invention is not intended to be restricted thereby.

Synthesis Example 1: Synthesis of 1,4-cyclohexanediol bis(benzenesulfonate) (compound No. I-1 in Table 1)

1.6 g of 1,4-cyclohexanediol and 37.1 g of benzenesulfonyl chloride were dissolved in 150 ml of pyridine. The resulting solution was allowed to react under stirring at 25° C. for six hours. After cooling, the pyridine hydrochloride thus formed as a by-product was filtered off and the filtrate was freed from the solvent. Thus 26.2 g of a crude product was obtained. By recrystallizing from ethanol, 26.2 g of a white solid product (m.p. 146° to 147° C. (decomp.)) was obtained.

This product showed the following characteristic absorptions in infrared spectrometry. Thus it was confirmed as the aimed compound.

Infrared spectrometric data: $\nu_{CH}$: 2950 $cm^{-1}$ and 1450 $cm^{-1}$. $\nu_{SO}$: 1360 $cm^{-1}$, 1340 $cm^{-1}$, 1190 $cm^{-1}$, 1170 $cm^{-1}$ and 590 $cm^{-1}$. $\nu_{c=c}$: 1600 $cm^{-1}$.

Synthesis Example 2: Synthesis of 2,2-bis(4-hydroxycyclohexyl)propane bis(4-methylbenzenesulfonate) (compound No. I-4 in Table 1)

2.40 g of 2,2-bis(4-hydroxycyclohexyl)propane and 40.0 g of 4-methylbenzenesulfonyl chloride were dissolved in 150 ml of pyridine. The resulting solution was allowed to react under stirring at 25° C. for four hours. The pyridine hydrochloride thus formed as a by-product was filtered off and the filtrate was freed from the solvent to thereby give crude crystals. By recrystallizing from ethanol, a product in the form of a white powder (m.p. 149° C. (decomp.)) was obtained.

This product showed the following characteristic absorptions in infrared spectrometry. Thus it was confirmed as the aimed compound.

Infrared spectrometric data: $\nu_{CH}$: 2950 $cm^{-1}$, 2860 $cm^{-1}$ and 1450 $cm^{-1}$. $\nu_{SO}$: 1330 $cm^{-1}$, 1290 $cm^{-1}$, 1280 $cm^{-1}$, 570 $cm^{-1}$ and 560 $cm^{-1}$. $\nu_{c=c}$: 1600 $cm^{-1}$.

Synthesis Example 3: Synthesis of 2,2-bis(4-hydroxycyclohexyl)propane bis(benzenesulfonate) (compound No. I-7 in Table 1)

The procedure of Synthesis Example 2 was repeated except that the 4-methylbenzenesulfonyl chloride was substituted with benzenesulfonyl chloride. Thus a product in the form of a white solid (m.p.: 124° C. (decomp.)) was obtained.

This product showed the following characteristic absorptions in infrared spectrometry. Thus it was confirmed as the aimed compound.

Infrared spectrometric data: $\nu_{CH}$: 2950 $cm^{-1}$, 2860 $cm^{-1}$ and 1450 $cm^{-1}$. $\nu_{SO}$: , 1350 $cm^{-1}$, 1340 $cm^{-1}$, and 610 $cm^{-1}$. $\nu_{c=1}$: 1590 $cm^{-1}$.

Synthesis Example 4: Synthesis of 2,2-bis(hydroxycyclohexyl)propane bis(methanesulfonate) (compound No. I-6 in Table 1)

12.0 g of 2,2-bis(4-hydroxycyclohexyl)propane and 12.0 g of methanesulfonyl chloride were dissolved in 50 ml of pyridine. The resulting solution was allowed to react under stirring at room temperature for three hours. The pyridine hydrochloride thus formed as a by-product was filtered off and the filtrate was freed from the solvent to thereby give a crude product. By recrystallizing from ethanol, 11.1 g of a product (m.p.

123 to 124° C. (decomp.)) was obtained in the form of a white powder.

This product showed the following characteristic absorptions in infrared spectrometry. Thus it was confirmed as the aimed compound.

Infrared spectrometric data: $\nu_{CH}$: 2950 $cm^{-1}$, 2870 $cm^{-1}$, 1470 $cm^{-1}$ and 1450 $cm^{-1}$. $\nu_{SO}$: 1350 $cm^{-1}$, 1330 $cm^{-1}$, 1180 $cm^{-1}$, 540 $cm^{-1}$ and 530 $cm^{-1}$.

Now the compound of the above general formula (II) to be used in the present invention will be described in detail.

Examples of the alkyl groups represented by X and Y in the general formula (II) include methyl, ethyl, propyl isopropyl, n-butyl, isobutyl, sec-butyl, tert-butyl, hexyl and trifluoromethyl groups.

Therefore examples of the compound of the general formula (II) are as follows.

TABLE 2

No. II-1

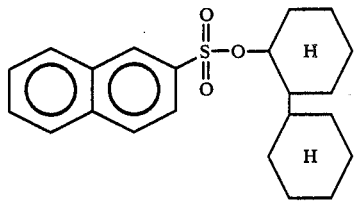

No. II-2

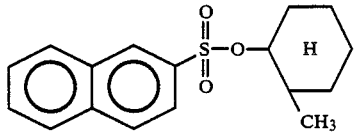

No. II-3

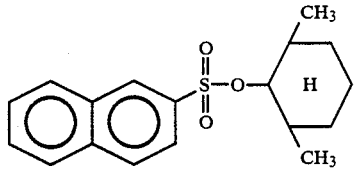

No. II-4

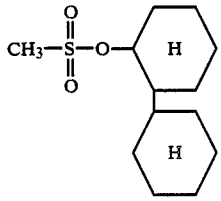

No. II-5

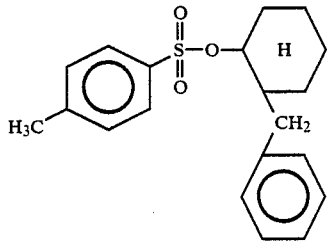

TABLE 2-continued

No. II-6

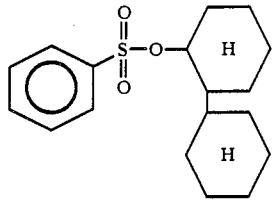

The 2-substituted cyclohexyl sulfonate compound can be readily prepared in a known manner, for example, by reacting benzenesulfonyl chloride with a 2-substituted cyclohexanol compound in the presence of a hydrochloric acid binder.

Some examples of a process for synthesizing the 2-substituted cyclohexyl sulfonate compound of the general formula (II) to be used in the present invention will be given.

Synthesis Example 5: Synthesis of 2-cyclohexylcyclohexyl β-naphthalenesulfonate (compound No. II-1 in Table 2)

12.47 g of β-naphthalenesulfonyl chloride and 9.16 g of 2-cyclohexylcyclohexanol were dissolved in 40 ml of pyridine in a flask provided with a stirrer, thermometer and reflux condenser. The resulting solution was stirred at room temperature for five hours. The pyridine hydrochloride thus formed as a by-product was filtered off and the filtrate was freed from the solvent to thereby give a crude product. By recrystallizing from ethanol, 18.0 g of white crystals (m.p.: 71° to 72° C. (decomp.)) were obtained.

This product showed the following characteristic absorptions in infrared spectrometry. Thus it was confirmed as the aimed compound.

$\nu_{CH}$ 2920 $cm^{-1}$, $\nu_{SO}$ 1350 $cm^{-1}$, 1190 $cm^{-1}$ and 670 $cm^{-1}$.

Synthesis Example 6: Synthesis of 2,6-dimethylcyclohexyl β-naphthalenesulfonate (compound No. II-3 in Table 2)

The procedure of Synthesis Example 5 was repeated except that the 2-cyclohexylcyclohexanol was substituted with 7.05 g of 2,6-dimethylcyclohexanol to thereby give a crude compound. By recrystallizing from isopropyl alcohol, white crystals (m.p.: 111° C.) was obtained.

This product showed the following characteristic absorptions in infrared spectrometry. Thus it was confirmed as the aimed compound.

$\nu_{CH}$ 2950 $cm^{-1}$, 2890 $cm^{-1}$, $\nu_{SO}$ 1360 $cm^{-1}$, 1350 $cm^{-1}$, 1180 $cm^{-1}$ and 660 $cm^{-1}$.

Now the compound represented by the above general formula (III) to be used in the present invention will be described in detail.

Examples of the aryl group represented by Ar in the general formula (III) include phenyl, naphthyl and biphenyl groups which are optionally substituted.

Examples of the cycloalkyl groups represented by $R_4$ and $R_5$ in the general formula (III) include those carrying five to eight carbon atoms, such as cyclopentyl, cyclohexyl, cycloheptyl and cyclooctyl groups, which are optionally substituted.

Therefore the compound of the general formula (III) to be used in the present invention are as follows:

TABLE 3

No. III-1

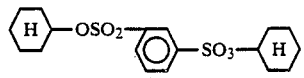

No. III-2

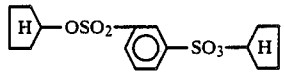

No. III-3

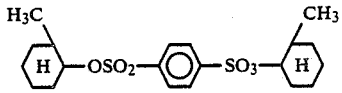

No. III-4

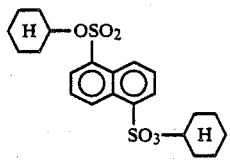

No. III-5

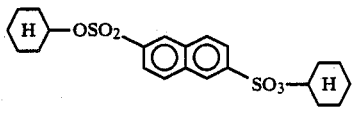

No. III-6

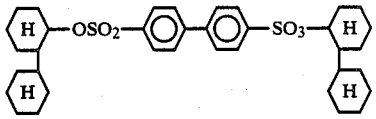

No. III-7

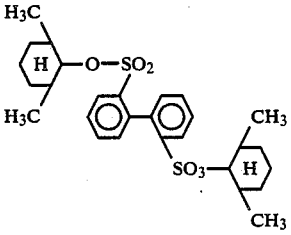

The biscycloalkyl aryldisulfonate of the general formula (III) can be readily prepared in a conventional manner, for example, by reacting an aryldisulfonic acid chloride with a cycloalkanol compound in the presence of a hydrochloric acid binder.

An example of a process for synthesizing the biscycloalkyl aryldisulfonate compound of the general formula (III) will be given.

Synthesis Example 7: Synthesis of biscyclohexyl m-benzenesulfonate (compound No. III-1 in Table 3)

8.25 g of m-benzenedisulfonyl dichloride and 6.31 g of cyclohexanol were dissolved in 30 ml of pyridine in a flask provided with a stirrer, a thermometer, a reflux condenser and a nitrogen inlet. The resulting solution was stirred under water-cooling. The precipitation of pyridine hydrochloride was observed approximately five minutes thereafter. After stirring at room temperature for two hours, the pyridine hydrochloride thus formed was filtered off and the filtrate was freed from the solvent at 40° to 50° C. to thereby give a crude product. By recrystallizing from ethanol, 8.5 g of white crystals (m.p.: 85° C. (decomp.)) were obtained.

This product showed the following characteristic absorptions in infrared spectrometry. Thus it was cinfirmed as the aimed compound.

$\nu_{CH}$ 2950 $cm^{-1}$, 2870 $cm^{-1}$, $\nu_{SO}$ 1360 $cm^{-1}$, 1200 $cm^{-1}$, 1180 $cm^{-1}$ and 590 $cm^{-1}$.

As described above, each of the compounds of the general formulae (I), (II) and (III) per se would show not only an excellent effect as a developer but also an effect of improving the stability upon storage. Thus it may be employed together with conventional developer(s) depending on the purpose, if required. Examples of the conventional developers include phenols, organic acids and metal salts thereof, such as p-octylphenol, p-tert-butylphenol, p-phenylphenol, bisphenol A, 1,1-bis(p-hydroxyphenyl)butane, 2,2-bis(4-hydroxy-3,5-dichlorophenyl)propane, bis[2-(4-hydroxyphenylthio)ethoxy]methane, p-(4-isopropoxybenzenesulfonyl)phenol, dimethyl 4-hydroxyphthalate, butyl bis(4-hydroxyphenyk) acetate, sulfobis(3,4-dihydroxybenzene), benzyl p-hydroxybenzoate, zinc salt of dodecyl salicylate, 3,5-ditert-butylsalicylic acid, 4,4-cyclohexylidenediphenol, p-hydroxydiphenoxide, α-naphthol, β-naphthol, p-hydroxyacetophenone, p-tert-butyloctylcathecol, 2,2'-dihydroxybiphenyl, 2,2-bis(3-methyl-4-hydroxyphenyl)propane, 2,2-bis(3,5-dimethyl-4-hydroxyphenyl)propane, 1,1,3-tris-(2-methyl-4-hydroxy-5-tert-butylphenyl)butane, and 1,1,3-tris-(2-methyl-4-hydroxy-5-cyclohexylphenyl)butane.

The colorless or light-colored coloring material to be used in the present invention may be selected from various known ones. Namely, those commonly used in pressure-sensitive recording paper or heat-sensitive recording paper may be used therefor without any limitation.

Examples of the coloring material include: (1) triarylmethane compounds such as 3,3-bis(p-dimethylaminophenyl)-6-dimethylaminophthalide (crystal violet lactone), 3-(p-dimethylaminophenyl)-3-(1,2-dimethyl-3-indolyl)phthalide, 3-(p-dimethylaminophenyl)-3-(2-phenyl-3-indolyl)phthalide, 3,3-bis(9-ethyl-3-carbazolyl)-5-dimethylaminophthalide and 3,3-bis-(2-phenyl-3-indolyl)-5-dimethylaminophthalide; (2) diphenylmethane compounds such as 4,4bis-dimethylamonobenzhydryl benzyl ether, N-halo-phenylleucoauramine and N-2,4,5-trichlorophenylleucoauramine; (3) xanthene compounds such as rhodamine-β-anilinolactam, 3-diethylamino-7-octylaminofluoran, 3-di-ethylamino-7-(2-chloroanilino)fluoran, 3-diethylamino-6-methyl-7-anilinofluoran, 3-diethylamino-6-chloro-7-(β-ethoxyethylamino)fluorane, 3-piperidino-6-methyl-7-anilinofluoran, 3-ethyltolylamino-6-methyl-7-anilinofluoran, 3-cyclohexylmethylanilino-6-methyl-7-anilinofluoran and 3-diethylamino-6-chloro-7-γ-chloropropylaminofluoran; (4) thiazine compounds such as benzoyl leucomethylene blue and p-nitrobenzoyl leucomethylene blue; and (5) spiro compounds such as 3-methylspirodinaphthopyran, 3-ethylspirodinaphthopyran, 3-benzylspirodinaphthopyran and 3-methylnaphtho-(3-methoxybenzo)spiropyran. Further a mixture comprising some of these colorants may be used in the present invention.

In the present invention, the compounds represented by the general formulae (I), (II) and (III) and the above-mentioned coloring material may be generally ground with the use of a grinder such as a ball mill, an atomizer or a sand grinder or an appropriate emulsifying device and various additives may be added thereto, depending on the purpose, to thereby give a coating fluid.

The coating fluid may generally comprise binder(s) such as polyvinyl alcohol, hydroxyethylcellulose, methylcellulose, polyacrylamide polymer, starches, styrene/maleic anhydride copolymer, vinyl acetate/maleic anhydride copolymer or styrene/butadiene copolymer; and filler(s) such as kaolin, kieselguhr, silica, talc, titanium dioxide, calcium carbonate, magnesium carbonate or aluminum hydroxide. It may further contain, if required, sensitizer(s) such as 4-benzyloxybiphenyl, 4-benzylbiphenyl, 1,2-bis(3-methylphenoxy)ethane, methylenebisbenzoate or benzyl 1-hydroxy-2-naphthoate; amine compound(s) such as triethylenetetramine or N,N-bis-(3-aminopropyl)ethylenediamine; metal soap(s) such as zinc stearate; wax(es); photostabilizer(s); water-resisting agent(s); dispersant(s); and anti-foaming agent(s).

This coating fluid is applied onto various films or sheets made of, for example, paper, synthetic paper or plastics. Thus the aimed heat-sensitive recording material of the present invention can be obtained.

The compounds of the abovementioned general formulae (I), (II) and (III) may be used in the present invention in an appropriate amount depending on the required performance, recording properties and the amount and type of additives to be used therewith without any restriction. These compounds are usually used in an amount of 0.1 to 10 parts by weight per part by weight of the coloring material. Examples:

To further illustrate the present invention, the following Examples will be given.

EXAMPLE 1

20 g of 2-anilino-3-methyl-6-diethylaminofluoran and 100 g of a 10% aqueous solution of polyvinyl alcohol were ground together in a ball mill to thereby give a coloring dispersant (fluid A).

Similarly, 20 g of each test compound as shown in Table 4 and 5 g of oxidized wax were ground together with 100 g of a 10% aqueous solution of polyvinyl alcohol in a ball mill to thereby give a developing dispersant (fluid B).

The fluids A and B were mixed at a ratio of 3:10. In 200 g of the resulting mixture was dispersed 50 g of a silica powder to thereby give a coating fluid.

This coating fluid was applied onto a paper substrate (50 g/m$^2$) at a coating weight of 6 g/m$^2$ and dried. Thus a heat-sensitive paper was obtained.

The obtained heat-sensitive paper was used in printing with the use of a commercially available heat-sensitive facsimile (NEFAX-3000; mfd. by Nippon Electric Co., Ltd.). After the completion of the printing, the densities of the print and the background were determined with a Macbeth Densitometer RD-933.

The above coloring material was stored at 50° C. and at a humidity of 90% for 48 hours. Separately, it was stamped with dioctyl phthalate and then stored at 50° C. under dry conditions for 48 hours. In each case, the densities of the print and the background were determined in the same manner as the one described above. Thus the residual ratio of the print after storage was calculated according to the following equation:

$$\text{residual ratio (\%)} = \frac{\text{density after storage}}{\text{density before storage}} \times 100$$

Table 4 shows the results.

TABLE 4

| | | Initial | | Stored at 50° C., 90% | | | DOP, stored at 50° C., dry conditions | | |
|---|---|---|---|---|---|---|---|---|---|
| No. | Test compound | background | print | background | print | residual ratio % | background | print | residual ratio % |
| Comp. Ex. | | | | | | | | | |
| 1-1 | bisphenol A | 0.09 | 1.03 | 0.21 | 0.72 | 70 | 0.27 | 0.37 | 36 |
| 1-2 | sec-butyl 4-methylbenzenesulfonate | 0.07 | 0.92 | 0.18 | 0.86 | 93 | 0.19 | 0.85 | 92 |
| Ex. | | | | | | | | | |
| 1-1 | cpd. I-1 (Table 1) | 0.07 | 1.20 | 0.10 | 1.16 | 97 | 0.10 | 1.20 | 100 |
| 1-2 | cpd. I-2 (Table 1) | 0.08 | 1.18 | 0.09 | 1.15 | 97 | 0.10 | 1.19 | 101 |
| 1-3 | cpd. I-4 (Table 1) | 0.08 | 1.22 | 0.10 | 1.20 | 98 | 0.11 | 1.24 | 102 |
| 1-4 | cpd. I-5 (Table 1) | 0.07 | 1.20 | 0.10 | 1.18 | 98 | 0.10 | 1.23 | 103 |
| 1-5 | cpd. I-7 (Table 1) | 0.08 | 1.21 | 0.09 | 1.21 | 100 | 0.10 | 1.28 | 106 |
| 1-6 | cpd. I-9 (Table 1) | 0.07 | 1.20 | 0.11 | 1.17 | 98 | 0.11 | 1.23 | 103 |

EXAMPLE 2

20 g of 3-dibutylamino-7-(o-chlorophenyl)-aminofluoroan and 100 g of a 10% aqueous solution of polyvinyl alcohol were ground together in a ball mill to thereby give a coloring dispersant (fluid A).

Similarly, 10 g of bisphenol A and 5 g of stearamide were ground together with 100 g of a 10% aqueous solution of polyvinyl alcohol in a ball mill to thereby give a dispersant (fluid B).

Further 20 g of each test compound as shown in Table 5 and 100 g of a 10% aqueous solution of polyvinyl alcohol were ground together in a ball mill to thereby give another dispersant (fluid C).

The fluids A, B and C were mixed at a ratio of 3:20:5. In 200 g of the resulting mixture was dispersed 50 g of calcium carbonate to thereby give a coating fluid.

This coating fluid was applied onto a paper substrate (50 g/m$^2$) at a coating weight of 6 g/m$^2$ and dried under a warm air stream. Thus a heat-sensitive paper was obtained.

The obtained heat-sensitive paper was subjected to the test as the one described in Example 1. Table 5 shows the results.

TABLE 5

| No. | Test compound | Initial | | Stored at 50° C., 90% | | | DOP, stored at 50° C., dry conditions | | |
|---|---|---|---|---|---|---|---|---|---|
| | | back-ground | print | back-ground | print | residual ratio % | back-ground | print | residual ratio % |
| Comp. Ex. | | | | | | | | | |
| 2-1 | bisphenol A | 0.09 | 1.02 | 0.20 | 0.67 | 66 | 0.32 | 0.41 | 40 |
| 2-2 | cyclohexyl benzene-sulfonate | 0.07 | 0.94 | 0.18 | 0.88 | 94 | 0.20 | 0.92 | 98 |
| Ex. | | | | | | | | | |
| 2-1 | cpd. I-1 (Table 1) | 0.06 | 1.21 | 0.07 | 1.15 | 95 | 0.09 | 1.16 | 96 |
| 2-2 | cpd. I-3 (Table 1) | 0.06 | 1.22 | 0.08 | 1.15 | 94 | 0.09 | 1.16 | 95 |
| 2-3 | cpd. I-4 (Table 1) | 0.07 | 1.23 | 0.09 | 1.18 | 96 | 0.08 | 1.20 | 98 |
| 2-4 | cpd. I-6 (Table 1) | 0.07 | 1.22 | 0.09 | 1.17 | 96 | 0.08 | 1.18 | 97 |
| 2-5 | cpd. I-7 (Table 1) | 0.06 | 1.21 | 0.07 | 1.18 | 98 | 0.08 | 1.21 | 100 |
| 2-6 | cpd. I-8 (Table 1) | 0.06 | 1.22 | 0.09 | 1.18 | 97 | 0.09 | 1.18 | 97 |

The above Tables 4 and 5 indicate that each heat-sensitive recording material of the present invention is excellent not only in coloring sensitivity but also in stability upon storage.

EXAMPLE 3

20 g of 2-anilino-3-methyl-6-diethylaminofluoroan and 100 g of a 10% aqueous solution of polyvinyl alcohol were ground together in a ball mill to thereby give a coloring dispersant (fluid A).

Similarly, 20 g of bisphenol A was ground together with 100 g of a 10% aqueous solution of polyvinyl alcohol in a ball mill to thereby give a developing dispersant (fluid B).

Further 20 g of each test compound as shown in Table 6 and 100 g of a 10% aqueous solution of polyvinyl alcohol were ground together in a ball mill to thereby give another dispersant (fluid C).

The fluids A, B and C were mixed at a ratio of 3:20:5. In 200 g of the resulting mixture was dispersed 50 g of calcium carbonate to thereby give a coating fluid.

This coating fluid was applied onto a paper substrate (50 g/m$^2$) at a coating weight of 6 g/m$^2$ and dried under a warm air stream. Thus a heat-sensitive recording material was obtained.

The obtained heat-sensitive paper was used in printing with the use of a commercially available heat-sensitive facsimile (NEFAX-3000; mfd. by Nippon Electric Co., Ltd.).

After the completion of the printing, the densities of the print and the background were determined with a Macbeth Densitometer RD-933.

The above coloring material was stored at 50° C. and at a humidity of 90% for 48 hours. Separately, it was stamped with dioctyl phthalate and then stored at 50° C. under dry conditions for 48 hours. In each case, the densities of the print and the background were determined in the same manner as the one described above. Thus the residual ratio of the print after storage was calculated according to the following equation:

$$\text{residual ratio (\%)} = \frac{\text{density after storage}}{\text{density before storage}} \times 100$$

Table 6 shows the results.

TABLE 6

| No. | Test compound | Initial | | Stored at 50° C., 90% | | | DOP, stored at 50° C., dry conditions | | |
|---|---|---|---|---|---|---|---|---|---|
| | | back-ground | print | back-ground | print | residual ratio % | back-ground | print | residual ratio % |
| Comp. Ex. | | | | | | | | | |
| 3-1 | bispheneol A | 0.09 | 1.03 | 0.21 | 0.72 | 70 | 0.27 | 0.37 | 36 |
| 3-2 | sec-butyl benzene-sulfonate | 0.07 | 0.92 | 0.18 | 0.81 | 88 | 0.19 | 0.85 | 92 |
| Ex. | | | | | | | | | |
| 3-1 | cpd. II-1 (Table 2) | 0.08 | 1.20 | 0.08 | 1.19 | 99 | 0.09 | 1.19 | 99 |
| 3-2 | cpd. II-2 (Table 2) | 0.07 | 1.20 | 0.09 | 1.17 | 98 | 0.10 | 1.23 | 103 |
| 3-3 | cpd. II-3 (Table 2) | 0.08 | 1.18 | 0.09 | 1.17 | 99 | 0.11 | 1.23 | 104 |
| 3-4 | cpd. II-4 (Table 2) | 0.08 | 1.21 | 0.10 | 1.18 | 98 | 0.12 | 1.20 | 99 |
| 3-5 | cpd. II-5 (Table 2) | 0.07 | 1.22 | 0.08 | 1.17 | 96 | 0.11 | 1.24 | 102 |

EXAMPLE 4

20 g of 3-dibutylamino-7-(o-chlorophenyl)-aminofluoran and 100 g of a 10% aqueous solution of polyvinyl alcohol were ground together in a ball mill to thereby give a coloring dispersant (fluid A).

Similarly, 10 g of benzyl p-hydroxybenzoate was ground together with 100 g of a 10% aqueous solution of polyvinyl alcohol in a ball mill to thereby give a developing dispersant (fluid B).

Further 20 g of each test compound as shown in Table 7 and 100 g of a 10% aqueous solution of polyvinyl alcohol were ground together in a ball mill to thereby give another dispersant (fluid C).

The fluids A, B and C were mixed at a ratio of 3:20:5. In 200 g of the resulting mixture was dispersed 50 g of calcium carbonate to thereby give a coating fluid.

This coating fluid was treated in the same manner as the one described in Example 3 to thereby give a heat-sensitive recording material, which was then tested in the same manner as the one described in Example 3. Table 7 shows the results.

TABLE 7

| No. | Test compound | Initial | | Stored at 50° C., 90% | | | DOP, stored at 50° C., dry conditions | | |
|---|---|---|---|---|---|---|---|---|---|
| | | back-ground | print | back-ground | print | residual ratio % | back-ground | print | residual ratio % |
| Comp. Ex. | | | | | | | | | |
| 4-1 | bisphenol A | 0.09 | 1.02 | 0.20 | 0.67 | 66 | 0.32 | 0.41 | 40 |
| 4-2 | cyclohexyl 4-methylbenzene-sulfonate | 0.07 | 0.90 | 0.18 | 0.81 | 90 | 0.20 | 0.82 | 91 |
| Ex. | | | | | | | | | |
| 4-1 | cpd. II-1 (Table 2) | 0.06 | 1.21 | 0.07 | 1.18 | 98 | 0.08 | 1.20 | 99 |
| 4-2 | cpd. II-2 (Table 2) | 0.06 | 1.23 | 0.09 | 1.16 | 94 | 0.09 | 1.19 | 97 |
| 4-3 | cpd. II-3 (Table 2) | 0.07 | 1.22 | 0.08 | 1.17 | 96 | 0.09 | 1.17 | 96 |
| 4-4 | cpd. II-5 (Table 2) | 0.07 | 1.21 | 0.07 | 1.16 | 96 | 0.08 | 1.17 | 97 |
| 4-5 | cpd. II-6 (Table 2) | 0.06 | 1.22 | 0.09 | 1.18 | 97 | 0.09 | 1.18 | 97 |

The above Tables 6 and 7 indicate that each heat-sensitive recording material of the present invention is highly excellent not only in coloring sensitivity but also in stability upon storage.

EXAMPLE 5

20 g of 2-anilino-3-methyl-6-diethylaminofluoroan and 100 g of a 10% aqueous solution of polyvinyl alcohol were ground together in a ball mill to thereby give a coloring dispersant (fluid A).

Similarly, 20 g of each test compound as shown in Table 8 was ground together with 100 g of a 10% aqueous solution of polyvinyl alcohol in a ball mill to thereby give a developing dispersant (fluid B).

The fluids A and B were mixed at a ratio of 3:10. In 200 g of the resulting mixture was dispersed 50 g of calcium carbonate to thereby give a coating fluid.

This coating fluid was applied onto a paper substrate (50 g/m$^2$) at a coating weight of 6 g/m$^2$ and dried under a warm air stream. Thus a heat-sensitive recording material was obtained.

The obtained heat-sensitive paper was used in printing with the use of a commercially available heat-sensitive facsimile (NEFAX-3000; mfd. by Nippon Electric Co., Ltd.). After the completion of the printing, the densities of the print and the background were determined with a Macbeth Densitometer RD-933.

The above coloring material was stored at 50° C. and at a humidity of 90% for 49 hours. Separately, it was stamped with dioctyl phthalate and then stored at 50° C. under dry conditions for 48 hours. In each case, the densities of the print and the background were determined in the same manner as the one described above. Thus the residual ratio of the print after storage was calculated according to the following equation:

$$\text{residual ratio (\%)} = \frac{\text{density after storage}}{\text{density before storage}} \times 100$$

Table 8 shows the results.

TABLE 8

| No. | Test compound | Initial | | Stored at 50° C., 90% | | | DOP, stored at 50° C., dry conditions | | |
|---|---|---|---|---|---|---|---|---|---|
| | | back-ground | print | back-ground | print | residual ratio % | back-ground | print | residual ratio % |
| Comp. Ex. | | | | | | | | | |
| 5-1 | bisphenol A | 0.09 | 1.03 | 0.21 | 0.72 | 70 | 0.27 | 0.37 | 36 |
| 5-2 | sec-butyl benzene-sulfonate | 0.07 | 0.92 | 0.18 | 0.81 | 88 | 0.19 | 0.85 | 92 |
| Ex. | | | | | | | | | |
| 5-1 | cpd. III-1 (Table 3) | 0.08 | 1.21 | 0.09 | 1.18 | 97 | 0.08 | 1.19 | 98 |
| 5-2 | cpd. III-2 (Table 3) | 0.09 | 1.19 | 0.10 | 1.15 | 97 | 0.09 | 1.22 | 103 |
| 5-3 | cpd. III-3 (Table 3) | 0.07 | 1.20 | 0.08 | 1.18 | 98 | 0.10 | 1.21 | 101 |
| 5-4 | cpd. III-4 (Table 3) | 0.08 | 1.18 | 0.10 | 1.17 | 99 | 0.09 | 1.19 | 101 |
| 5-5 | cpd. III-5 (Table 3) | 0.09 | 1.20 | 0.08 | 1.18 | 98 | 0.10 | 1.20 | 100 |
| 5-6 | cpd. III-6 (Table 3) | 0.07 | 1.19 | 0.10 | 1.15 | 97 | 0.11 | 1.21 | 102 |
| 5-7 | cpd. III-7 (Table 3) | 0.08 | 1.21 | 0.11 | 1.17 | 97 | 0.09 | 1.19 | 98 |

EXAMPLE 6

In order to examine the effect of the biscycloalkyl aryldisulfonate of the present invention as a sensitizer, a heat-sensitive recording material was prepared in the following manner.

20 g of 3-dibutylamino-7-(o-chlorophenyl)-aminofluoran and 100 g of a 10% aqueous solution of polyvinyl alcohol were ground together in a ball mill to thereby give a coloring dispersant (fluid A).

Similarly, 10 g of bisphenol A was ground together with 110 g of a 10% aqueous solution of polyvinyl alcohol in a ball mill to thereby give a developing dispersant (fluid B).

Further 20 g of biscyclohexyl m-benzenedisulfonate (cpd. No. III-1 in Table 3) and 100 g of a 10% aqueous solution of polyvinyl alcohol were ground together in a ball mill to thereby give a sensitizing dispersant (fluid C).

The fluids A, B and C were mixed at the following ratio. In 200 g of the resulting mixture was dispersed 50 g of calcium carbonate to thereby give a coating fluid.

| | Fluid A | Fluid B | Fluid C | PVA* |
|---|---|---|---|---|
| Comp. Ex. 6-1 | 3 | 20 | 0 | 11 |
| 6-2 | 3 | 30 | 0 | 0 |
| 6-3 | 3 | 20 | 10*2 | 0 |
| Ex. 6-1 | 3 | 0 | 10 | 24 |
| 6-2 | 3 | 20 | 10 | 0 |

Note:
*1 10% aqueous solution of polyvinyl alcohol.
*2 methylenedibenzoate.

This coating fluid was treated in the same manner as the one described in Example 5 to thereby give a heat-sensitive recording material, which was then tested in the same manner as the one described in Example 5. Table 9 shows the results.

TABLE 9

| | Intial | | Stored at 50° C., 90% | | | DOP, stored at 50° C., dry conditions | | |
|---|---|---|---|---|---|---|---|---|
| No. | back-ground | print | back-ground | print | residual ratio % | back-ground | print | residual ratio % |
| Comp. Ex. | | | | | | | | |
| 6-1 | 0.08 | 1.05 | 0.21 | 0.71 | 68 | 0.22 | 0.38 | 36 |
| 6-2 | 0.09 | 1.11 | 0.24 | 0.82 | 70 | 0.28 | 0.41 | 37 |
| 6-3 | 0.11 | 1.17 | 0.18 | 1.86 | 74 | 0.20 | 0.64 | 55 |
| Ex. | | | | | | | | |
| 6-1 | 0.07 | 1.17 | 0.08 | 1.17 | 100 | 0.08 | 1.16 | 99 |
| 6-2 | 0.08 | 1.24 | 0.09 | 1.22 | 98 | 0.10 | 1.20 | 97 |

The above Tables 8 and 9 indicate that each heat-sensitive recording material of the present invention is highly excellent not only in coloring sensitivity but also in stability upon storage.

What is claimed is:

1. A heat-sensitive recording material which comprises a substrate carrying a usually colorless or light-colored coloring material and one or more color developers selected from the compounds represented by the following formulae (I), (II) and (III):

formula (I):

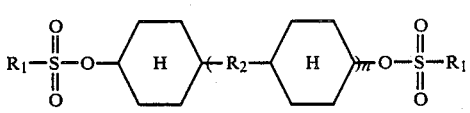

(I)

wherein $R_1$ represents an alkyl group, an aryl group, an aralkyl group or an alkylaryl group each optionally substituted with a halogen atom, an alkoxy group, an acyl group, an alkoxycarbonyl group or a nitro group;

$R_2$ represents a direct bond, an alkylidene, —O—, —S— or —$SO_2$—; and n is 0 or 1, formula (II):

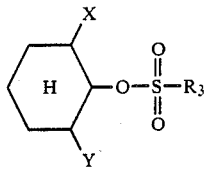

(II)

wherein $R_3$ represents an alkyl group, an aryl group, a cycloalkl group, an arylalkyl group or an alkylaryl group; and X and Y each independently represent a hydrogen atom, an alkyl group, a cycloalkyl group or an arylalkyl group, provided that X and Y do not simultaneously represent hydrogen atoms, formula (III):

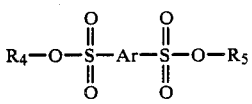

(III)

wherein $R_4$ and $R_5$ each independently represent a cycloalkyl group or a substituted cycloalkyl group; and Ar represents an aryl group.

2. A heat-sensitive recording material as set forth in claim 1, which comprises said compounds of the formulae (I), (II) and (III) in an amount of 0.1 to 10 parts by weight per part by weight of said coloring material.

* * * * *